US005391135A

United States Patent [19]

Kuroki et al.

[11] Patent Number: 5,391,135

[45] Date of Patent: Feb. 21, 1995

[54] ROLLS FOR HOT DIPPING BATH

[75] Inventors: Nobuyuki Kuroki, Chiba; Akiyosi Kohma, Hyogo; Hidekatu Okuma; Shoichi Fukamizu, both of Chiba, all of Japan

[73] Assignees: Tocalo Co., Ltd., Hyogo; Kawatetsu Galvanizing Co., Ltd., Tokyo, both of Japan

[21] Appl. No.: 51,858

[22] Filed: Apr. 26, 1993

[51] Int. Cl.[6] ..... B05C 1/00

[52] U.S. Cl. ..... 492/35; 492/30; 492/34

[58] Field of Search ..... 492/30–37

[56] References Cited

U.S. PATENT DOCUMENTS

| | | | |
|---|---|---|---|
| 1,601,154 | 9/1926 | Wheeler | 492/31 |
| 1,805,780 | 5/1931 | Millspaugh | 492/31 |
| 1,954,635 | 4/1934 | Leonard, Jr. | 492/31 |
| 1,957,963 | 5/1934 | Johnstone | 492/32 |
| 4,068,620 | 1/1978 | Peters | 492/31 |
| 4,084,302 | 4/1978 | Aatinen | 492/35 |
| 4,291,438 | 9/1981 | Seiki et al. | 492/30 |
| 4,819,558 | 4/1989 | Counard | 492/31 |
| 4,996,113 | 2/1991 | Hector et al. | 492/35 |

FOREIGN PATENT DOCUMENTS

| | | | |
|---|---|---|---|
| 58-25468 | 2/1983 | Japan . | |
| 58-37386 | 8/1983 | Japan . | |
| 1-79356 | 3/1989 | Japan . | |
| 1-108334 | 4/1989 | Japan . | |
| 2-43352 | 2/1990 | Japan . | |
| 2-236266 | 9/1990 | Japan . | |
| 3-74654 | 7/1991 | Japan . | |
| 4-13854 | 1/1992 | Japan . | |
| 0002789 | 12/1986 | United Kingdom | 492/31 |
| 0572306 | 9/1977 | U.S.S.R. | 492/30 |
| 1121075 | 10/1984 | U.S.S.R. | 492/30 |

OTHER PUBLICATIONS

English Abstract of Japanese Patent No. 1–108334.
English Abstract of Japanese Patent No. 58–25468 & 58–32386.
English Abstract of Japanese Patent No. 1–79356.
English Abstract of Japanese Patent No. 3–74654.
English Abstract of Japanese Patent No. 2–43552.
English Abstract of Japanese Patent No. 2–236266.
English Abstract of Japanese Patent No. 4–13854.
JIS H8303–1989, "Spray Fused Deposits of Self–Fluxing Alloys", *Japanese Industrial Standard,* in Japanese and English.

*Primary Examiner*—Irene Cuda
*Attorney, Agent, or Firm*—Sandler Greenblum & Bernstein

[57] ABSTRACT

A roll for hot dipping bath includes at its outer peripheral surface at least one spiral groove for the discharge of dross. In this roll, the outer peripheral surface existing between the adjoining groove portions includes a rough surface, capable of applying a molten metal composition to a sheet of metal without transferring a groove mark to the sheet.

16 Claims, 3 Drawing Sheets

ROLLS FOR HOT DIPPING BATH

BACKGROUND OF THE INVENTION

1. Field of the Invention

This invention relates to a roll used for guiding and running a steel sheet, or the like, among bath members arranged in a hot dipping apparatus, such as an immersion roll in a hot dipping bath (hereinafter referred to as a sink roll), and more particularly to an improvement in a surface structure of a sink roll applied to a hot dipping process of non-ferrous metal such as galvanization, aluminum hot dipping, zinc-aluminum hot dipping, tin hot dipping or the like.

2. Description of Background Material

The sink roll used in a galvanizing apparatus or aluminum hot dipping apparatus is immersed in a hot dipping bath as shown in FIG. 1. Since the sink roll is always used under the severe condition of immersion in molten metal, such as molten zinc or the like, it is fundamentally required to have the following functions:

(1) The roll surface is hardly eroded by molten metal;

(2) The roll surface is hardly abraded even in contact with a passing steel sheet and can maintain its initial shape accuracy for a long time; and (3) Though the roll is a consumption article, the service life is long and the rise of cost in the apparatus can be suppressed.

Furthermore, the sink roll serves to guide the passing of the steel sheet and change the passing direction thereof in the hot dipping bath, so that the following functions are further required:

(4) The foreign matter suspended and floating in the hot dipping bath. ("dross", fine particles of Fe-Zn alloy or particles mechanically bonded with a metal component in the hot dipping, which has a melting point higher than that of metallic Zn and adheres to the surface of the steel sheet to cause a shape defect of a dipped layer and hence causes a surface defect of the product) hardly adheres to the steel sheet to be dipped; and (5) In general, a helical groove for discharging the dross is formed on the outer surface of the sink roll, but the ununiform dipped portion, corresponding to the groove shape, is formed in the dipped steel sheet to cause surface defects such as uneven color tone, uneven gloss and the like (which is called a groove mark), so that it is required to prevent the occurrence of the surface defect even with use of a helical groove.

As the conventional sink roll satisfying the above requirements, there are (a) a sink roll provided at its outer peripheral surface with a coating layer having an excellent erosion resistance to molten metal, and (b) a sink roll provided at its outer peripheral surface with a groove having an improved shape. As the former roll, there are known (i) a spray-coating layer of cobalt self-fluxing alloy, as defined in JIS H8303-1989, (ii) a coating layer of Mo, W added to the above self-fluxing alloy for improving resistance to erosion of molten metal, as described in Japanese Patent laid open No. 1-108334, (iii) a coating layer of WC or CrC or TiC and a hot corrosion resistant metal having a thickness of 0.1–2.4 mm, as described in Japanese Patent Application Publication No. 58-37386, and the like.

As the latter roll, there is known (iv) a roll provided at its surface with plural grooves, as shown in FIGS. 2*a* and 2*b*. These grooves are a spiral groove formed in a unidirection toward a mother line of the roll or spiral grooves formed from a center of axis in opposite directions. A portion between the grooves has a flat shape. Further, there are proposed various methods of producing the spiral grooves, one of which is (v) a sink roll for hot dipping provided at its outer surface with a cross groove having a pitch of 20–60 mm, a depth of 0.5–10 mm, a width of 5–10 mm, and R of 3–10 mm as disclosed in Japanese Patent laid open No. 64-79356.

These conventional techniques are effective for the stabilization of the roll surface shape over a long period, reduction of dross adhered to the roll surface and the like in their own ways. However, the quality of the galvanization required in recent rust-preventive steel sheets for automobiles and the like has become considerably higher, and it is considered that the improvement of quality by the conventional techniques is insufficient. That is, it is actually demanded to improve the surface quality against uneven color tone, uneven gloss or the like even with the mechanical properties of the galvanized steel sheets, as well as the galvanized surface, as an undercoat for paint aimed at the invention.

Under such circumstances, the inventors have made various studies in order to improve the quality of the galvanized surface and confirmed that when the spiral grooves are formed on the surface of the roll, as described in Japanese Patent laid open No. 64-79356, to overcome various problems, uneven color tone or uneven gloss of the galvanized layer is caused by the spiral groove. That is, the steel sheet to be galvanized contacts the spiral grooves for the discharge of dross and the flat portions adjacent thereto, as shown in FIG. 2. The difference in the shape between the groove and the flat portion creates a strip pattern, called a "groove mark", on the galvanized steel sheet, which renders a defect in the galvanization appearance, such as uneven color tone, uneven gloss or the like in the galvanized surface of the steel sheet. Furthermore, it has been found that the groove mark remarkably occurs in a new product.

On the contrary, in order to prevent the occurrence of the groove mark, there are considered (1) a method of adjusting the tension of the steel sheet, the sheet passing velocity, the temperature of steel sheet, composition the of galvanizing bath and the like, and (2) a method of preliminarily passing a pretreated steel sheet, called as a dummy steel sheet, through a galvanizing bath for 8–24 hours to conduct conditioning and then actually passing a steel sheet to be galvanized therethrough. In the method (1), however, the thickness of the steel sheet to be produced, and the temperature and tension of the steel sheet in the hot-dipping bath, in accordance with the width thereof, change and hence it is difficult to find stable conditions. When the composition of the galvanizing bath is adjusted so as to make the groove mark unclear, such an adjustment is very difficult because it is conflicts with the adhesion property of the galvanized layer. On the other hand, the method (2) considerably lowers the productivity and hence is difficult to put into practical use.

From the above, it is clear that the formation of the spiral grooves through the conventional technique can not completely prevent the occurrence of the groove mark, even when conducting the improvement of any operations.

SUMMARY OF THE INVENTION

It is, therefore, an object of the invention to overcome the aforementioned problems of the conventional techniques by mechanically reviewing the microshape of the roll surface to provide preferable conditions not causing the groove mark and then maintaining such preferable conditions for a long time.

The inventors have found that in the sink roll provided at its outer peripheral surface with spiral grooves and flat portions between the grooves, as shown in FIG. 2, when the steel sheet is traveled while winding about the sink roll in the galvanizing bath, as the winding angle becomes small, the groove shape on the outer peripheral surface of the roll is hardly transferred on the steel sheet to be galvanized, Furthermore, it has been found that the limit of observing the groove shape as a groove mark is when the steel sheet contacts with the roll in line. Therefore, the inventors have found out that in order to contact the steel sheet with the flat portion between the spiral grooves through the composition of the bath without directly conducting plane contact, the flat portion between the spiral grooves is rendered into an uneven surface.

According to the invention, a roll for hot dipping bath is provided at its outer peripheral surface with grooves for the discharge of dross, characterized in that the outer peripheral surface existing between the grooves is rendered into a rough surface.

In preferred embodiments, the rough surface is comprised of undulations having a difference of height within a range of 0.5–5 mm, and the distribution of the convex regions in the rough surface is within a range of 10–250 regions/1 $cm^2$. Furthermore, the top portion of the convex region is preferably made from a carbide, an oxide, a boride or a cermet thereof.

BRIEF DESCRIPTION OF THE DRAWINGS

The invention will be described with reference to the accompanying drawings, wherein.

DESCRIPTION OF THE PREFERRED EMBODIMENTS

Figure 1:
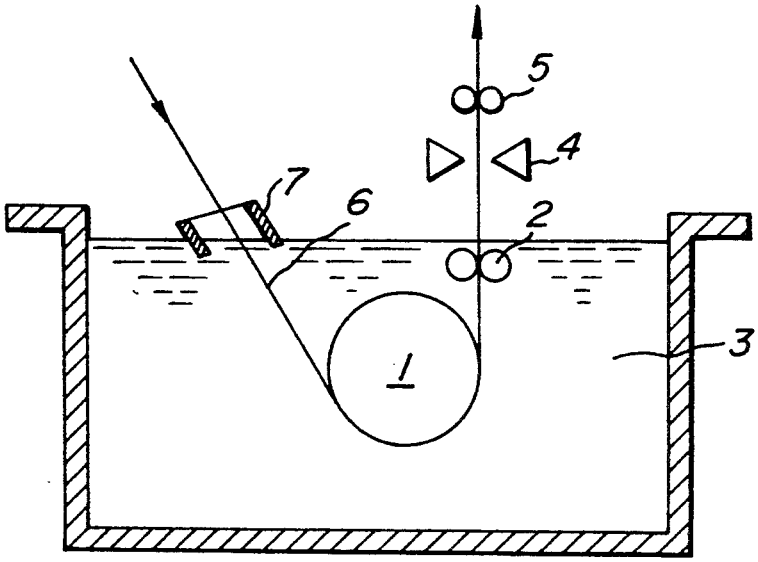
FIG. 1 is a schematic view showing an outline of a continuous galvanizing apparatus for steel sheets.

It is theoretically desirable that the sink roll for guiding the steel sheet in the hot dipping bath does not have spiral grooves, as mentioned above. In the hot dipping treatment, however, the formation and agglomeration of Zn-Fe alloy (dross) at the contact interface between the steel sheet and the roll is unavoidable. Therefore, it is required to form passages for automatically discharging the dross. These passages are usually in the form of grooves having various sizes and shapes on the roll.

In general, the passages for the discharge of the dross are necessarily formed as a groove of spiral shape (V-shape, U-shape, rectangle or the like) from a viewpoint of a rotating mechanism accompanied with the passing of the steel sheet. Such grooves (hereinafter referred to as spiral groove) are basically a single groove as seen from a developed view of the roll surface. Therefore, when any mother line on the outer peripheral surface of the roll is taken as a standard, there is a relationship between the groove portions separated with each other without connecting them. This means that when such a roll is used in the hot-dipping bath, the spiral groove portions contain a great amount of the dipping solution and fluid-contact with the steel sheet, while the flat portions sandwiched between the adjoining spiral grooves substantially rigidly contact their surfaces with the steel sheet. As a result, the difference in the action of the hot-dipping composition on the steel sheet is caused between the groove portion and the flat portion, which is considered to create a so-called groove mark.

The inventors have studied (a) the difference in reaction time of the hot-dipping composition, (b) the difference of the hot-dipping composition considering a theory of boundary layer, (c) the difference of contact pressure with the hot-dipping composition, and the like as the above difference of the action between the spiral groove portion and the flat portion. Assuming that the groove mark is created by the difference in the microscopic reaction conditions between the hot-dipping composition and the steel sheet, the inventors have guessed that the occurrence of the groove mark, resulting from the difference of the dipping reaction conditions, can be prevented by setting the contact conditions, capable of exhibiting the same reaction, at any contact positions between the outer surface of the roll and the steel sheet to thereby equalize the hot-dipping conditions existing on the groove portion and the flat portion adjacent thereto.

With the foregoing in mind, the inventors have investigated the action of the flat portion so as to be equal to that of the spiral groove portion adjacent thereto or the structure of supplying the same hot-dipping composition. Particularly, the inventors have investigated the surface roughening of the flat portion, particularly a means for forming unevenness of regular or irregular pattern on the outer peripheral surface of the roll other than the spiral groove portions. As to such an unevenness, a relationship to the occurrence of the groove mark is examined in detail by varying concrete size and shape. In general, the hot-dipping composition is essentially molten metal and has a surface tension because of its viscosity, so that it is confirmed that molten metal is hardly wettable to a rough or uneven surface rather than the flat surface order to equally insert molten metal into the unevenness at wet state, the uneven portion is required to have a difference in depth higher than a given value. Moreover, it is anticipated that if the uneven portion becomes larger than a given value, it transfers a pattern corresponding to the groove mark to the steel sheet to be galvanized.

In the invention, there are used (1) a cutting method, (2) a discharge working method, (3) a laser beam working method, (4) a so-called blast working method of blowing shot or grit materials with high pressure air, (5) a working method of adhering fine pins through embed welding, and the like as a method of forming a desirable uneven pattern on the flat portions between the adjoining spiral groove portions. A test roll is made from SUS 304 stainless steel or 13 Cr steel and has a diameter of 600 mm and a length of 1500 mm, and is previously provided at its surface width a spiral groove of U-shape for discharge of dross having a depth of 1.5 mm, a width of 6 mm and a pitch of 25 mm. In this case, the length of the flat portion adjacent to the spiral groove is about 18 mm, viewed on a mother line of the roll. One of the rolls is used as it is, while the flat portions in the other remaining rolls are provided with the unevennesses of various sizes by the above methods. These rolls are usually immersed in the galvanizing bath, and then steel sheets are passed and guided therethrough to measure the state of causing the groove mark on the surface of the steel sheet.

Table 1 shows the relationship among the unevenness on the roll surface, the method of forming the unevenness and the state of causing the groove mark on the surface of the steel sheet. As seen from Table 1, the groove mark is not caused when the difference in the depth of the uneven pattern is within a range of 0.5–5.0 mm and the uneven pattern is triangular pyramid, rectangular pyramid, prism, column or the like.

TABLE 1

| Run No. | Working process | | Shape of convex region | * Height of convex region (mm) | Evaluation of groove mark caused on surface of hot-dipped steel sheet |
|---|---|---|---|---|---|
| | | | Aceptable Example | | |
| 1 | Undulation working of flat portion | Cutting process | square pillar | 0.6 | ◎ |
| 2 | | | square pyramid | 2.0 | ◎ |
| 3 | | | triangular pyramid | 4.5 | ○ |
| 4 | | Discharge working process | square pillar | 0.6 | ◎ |
| 5 | | | | 2.0 | ◎ |
| 6 | | | | 4.5 | ○ |
| 7 | | Laser beam working process | square pillar | 0.5 | ◎ |
| 8 | | | square pyramid | 0.9 | ◎ |
| 9 | | | triangular pyramid | 1.3 | ○ |
| 10 | | Pin-welding adhesion process | | 0.5 | ◎ |
| 11 | | | column | 4.0 | ◎ |
| | | | Comparative Example | | |
| 12 | Undulation working of flat portion | Cutting process | square pillar | 0.1 | X |
| 13 | | | | 0.3 | X |
| 14 | | | square pyramid | 5.2 | X |
| 15 | | Discharge working process | | 0.1 | X |
| 16 | | | square pillar | 0.3 | X |
| 17 | | | | 5.5 | X |
| 18 | | Laser beam working process | square pillar | 0.1 | X |
| 19 | | | square pyramid | 0.4 | X |
| 20 | | | triangular pyramid | 5.2 | X |
| 21 | | Blast working process | rough surface formed by grid material | 0.08 | X |
| 22 | | | | 0.15 | X |
| 23 | No working of flat portion | | | — | X |

<Remarks>:
◎ no groove mark
○ groove mark is partly observed on both end portions of the steel sheet widthwise direction.
X groove mark is clearly observed.
* difference in height between convex and concave faces

TABLE 2

| Run No. | Number of convex regions per 1 cm² | Height of convex region (mm) | Groove mark or ununiform pattern defect on surface of hot-dipped steel sheet | Remaining ratio of convex region height after operation of 30 days (%) |
|---|---|---|---|---|
| | | Acceptable Example | | |
| 1 | 240 | 0.5 | ○ | 89 |
| 2 | 65 | 0.6 | ○ | 97 |
| 3 | 25 | 0.8 | ○ | 98 |
| 4 | 16 | 4.5 | ○ | 98 |
| | | Comparative Example | | |
| 5 | 324 | 0.5 | ○ | 30 |
| 6 | 290 | 0.5 | ○ | 40 |

TABLE 2-continued

| Run No. | Number of convex regions per 1 cm² | Height of convex region (mm) | Groove mark or ununiform pattern defect on surface of hot-dipped steel sheet | Remaining ratio of convex region height after operation of 30 days (%) |
|---|---|---|---|---|
| 7 | 9 | 0.8 | X | 98 |
| 8 | 4 | 4.0 | X | 98 |

Figure 3:
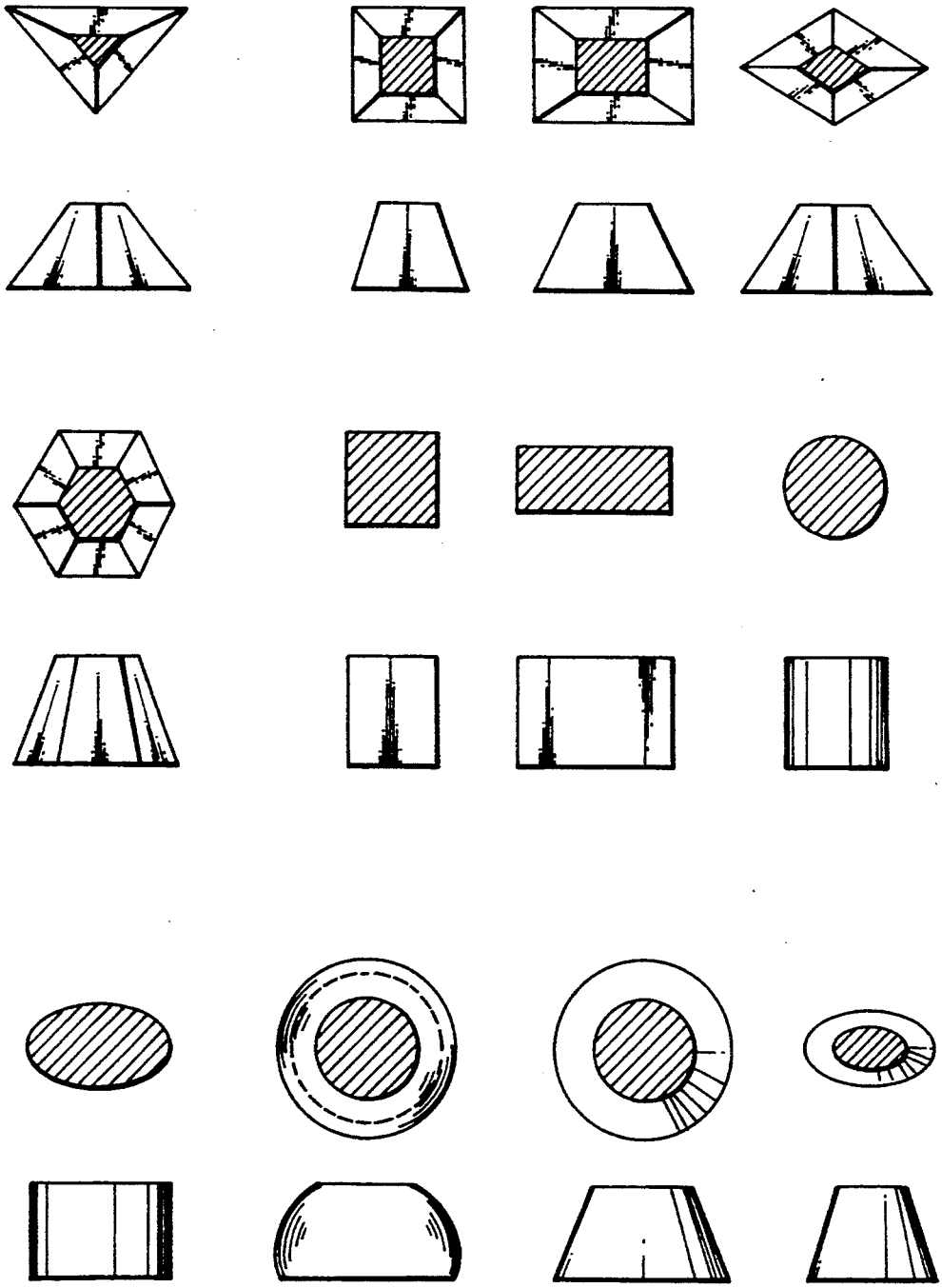
FIG. 3 schematically shows various embodiments of the protrusion according to the invention.

<Remarks>
○: within an acceptable range
X: outside an acceptable range
Height of convex region . . . difference in height between convex and concave faces
percentage to initial value of working height Table 2 shows the results of the varying density in the formation of the convex region and shows a relation between the influence on the occurrence of a groove mark and the shape-holding life. As seen from Table 2, in view of the function and its holdability, the number of convex regions per 1 cm² of the roll surface has an adaptable range, and the convex regions are properly maintained without the occurrence of a groove mark when the density of the convex region on the outer peripheral surface of the roll is 10–250 convex regions per 1 cm². If the density is too large, the space between the convex regions is clogged with dross. FIG. 3 shows various shapes of the convex region formed in the unevenness surface.

Figure 4A:
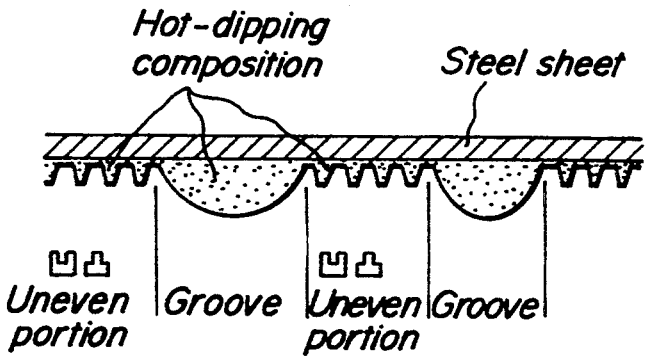
FIG. 4*a* is a diagrammatical view showing a contact state between a surface of the roll according to the invention and a surface of a steel sheet to be galvanized.
Figure 4B:
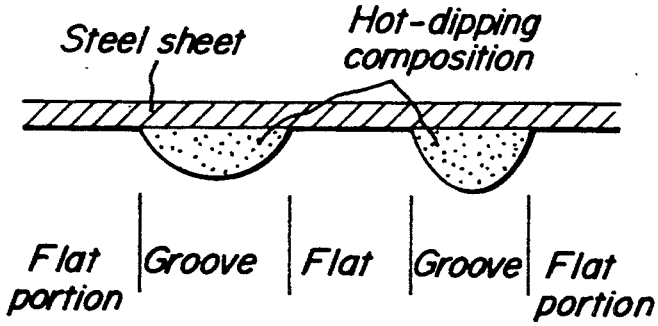
FIG 4b PRIOR ART
FIG. 4*b* is a diagrammatical view showing a contact state between a surface of the conventional roll and a surface of a steel sheet to be galvanized.

The uneven shape of the flat portion formed on the outer peripheral surface of the roll usable in the invention is preferably connects the adjoining groove portions with each other, as schematically shown in FIG. 4*a*. When the steel sheet is wound around the roll, having such an uneven shape, the hot-dipping composition in the spiral groove portion and uneven portion has a hydrostatic pressure equal therebetween without changing contact conditions. It can be said that the invention is essentially different from the simple formation of the groove through the conventional technique because the hot dipping composition of equal hydrostatic pressure exists between the spiral groove portion and the uneven portion.

As mentioned above, according to the invention, the shape of the unevenness, particularly the convex region formed on the surface of the roll, should have a structure that the hot-dipping composition can sufficiently be stored and fed to the steel sheet together with the hot-dipping composition existent in the groove portions. That is, the steel sheet is subjected to the same hot-dipping reaction condition at any position on the outer peripheral surface of the roll to form a uniform galvanized layer on the surface of the steel sheet and hence the occurrence of groove mark can be prevented.

In the invention, it is preferable that the outer peripheral surface of the roll, particularly the unevenness surface, is covered with a layer of a carbide, an oxide, a boride or a cermet thereof as mentioned later. In general, the roll immersed in the continuous hot-dipping apparatus is made from an alloy steel such as austenitic stainless steel, 13 Cr steel or the like. On the other hand, the hot-dipping metal, such as zinc or the like, is active and rich in the reaction with steel material, and produces various Fe alloys. Particularly, the roll immersed in the apparatus reacts with the hot-dipping composition to form an alloy layer covering the surface of the roll in a short time. It is very difficult to maintain the roll provided at its surface with the fine unevenness portion over a long period of time. Now, the inventors have made studies on the change of the unevenness shape due to erosion of the hot-dipping composition and found that it is effective to cover the surface of the roll with the layer of carbide, oxide, boride or cermet thereof.

There are provided (1) a roll of SUS 304 stainless steel having the spiral groove and unevenness portions as mentioned above, and (2) a roll formed by spraying a cermet of WC-Co on the surface of the roll (1) at a thickness of not less than 40 μm but less than 100 μm, which are immersed in a galvanizing bath of 480° C. to measure a change of the surface state. As a result, the unevenness portions on the surface of the roll (1) disappear due to the erosion of hot-dipped zinc to SUS 304 stainless steel matrix after 5–10 hours, while the unevenness portions of the roll (2) are maintained at their initial state even after 800 hours. As seen from this result, in order to maintain the effect of the unevenness portion, it is effective to form a sprayed layer of WC-Co cermet on the unevenness portion in the outer peripheral surface of the roll.

As mentioned above, it is more effective to simultaneously form regular or irregular unevenness on portions located between adjoining spiral groove portions on the surface of the roll in the hot-dipping bath and provide a ceramic coating having excellent resistance to hot-dipping metal on the uneven surface.

In the above embodiment, the flat portion adjacent to the spiral groove is first rendered into the unevenness, and then the WC-Co cermet is sprayed thereonto. Such a working procedure may be reversed in accordance with the kind of the surface coating layer. For example, when a layer of a metal oxide such as chromium oxide is formed on the uneven surface, it is first put on the flat portion, at a necessary thickness through spraying and then the fine convex regions are formed by laser beam engraving.

The shape of the convex region according to the invention is not limited to those described above, and may be polygonal pyramid, cone, column, ellipsoid, spherical body or the like.

The following examples are given in illustration of the invention and are not intended as limitations thereof.

EXAMPLE 1

A V-shaped groove having a depth of 1.5 mm, a width of 6 mm and a pitch 25 mm is spirally formed on a surface of a sink roll for galvanizing bath made from 13 Cr stainless steel having a diameter of 700 mm and a surface length of 1800 mm through cutting. Thereafter an unevenness shape according to the invention, as shown in Table 1, is formed on a flat portion between the resulting adjacent spiral groove portions as an assembly of square pyramids each having a side of 2.2 mm and a height of 0.7 mm at bottom with a density of 20 pyramids per 1 $cm^2$ through cutting. Further, a WC-12%Co cermet is sprayed on the surface of the thus treated roll at a thickness of 0.08–0.09 mm.

The roll is actually used in a galvanizing bath at a temperature of 480° C. As a result, a galvanized steel sheet hardly observing a groove mark is obtained immediately after the start of the operation. Naturally, the adjustment of the bath composition, bath temperature and tension of the steel sheet required in the initial conditioning (adjustment of hot-dipping conditions) are unnecessary, so that the galvanized steel sheets having excellent surface quality are obtained from the starting stage of the operation. Therefore, the use of such a roll can omit a step of passing a dummy steel sheet for 8–24 hours, which has been required at the starting time of the operation in the conventional apparatus. In the conventional technique, the tension of the steel sheet is lowered from the given value in order to mitigate the occurrence of a groove mark. This results in the slipping of the steel sheet and causes surface defects such as scratches, or the like, in the galvanized steel sheet. According to the invention, the occurrence of surface defects and slipping of the steel sheet hardly occur even when the tension is made high. Moreover, when the roll is observed by taking it out of the bath, for the exchange operation of surrounding members such as roll shaft portion and the like, the shapes of the spiral groove portion and the unevenness portion adjacent thereto hardly change. Of course, the adjustment of operation conditions using the dummy steel sheet even in reuse becomes unnecessary. As a result, the roll could be used over 50 days till the surface shape of the roll is gradually lost and badly influences the galvanization quality.

Figure 2A:
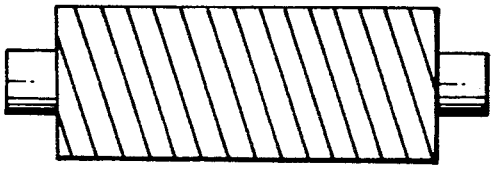
FIG 2a PRIOR ART
FIGS. 2*a* and 2*b* are schematic views showing shapes of spiral grooves formed on the sink roll, respectively.
Figure 2B:
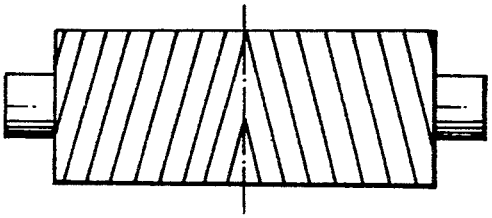
FIG 2b PRIOR ART

A product to be used in this example is a galvanized steel sheet for an outer panel of an automobile requiring beauty of the galvanized surface and deep drawability. In this production, the service life of the conventional roll, as shown in FIG. 2, is about 5–15 days. Therefore, the service life of the sink roll used in this example is about 3.5 times of that of the conventional roll, and also the productivity at the initial stage of the galvanizing operation can considerably be improved.

EXAMPLE 2

A V-shaped groove having a depth of 1.5 mm, a width of 6 mm and a pitch 25 mm is spirally formed on a surface of a sink roll for galvanizing bath made from SUS 304 austenitic stainless steel having a diameter of 800 mm and a surface length of 1800 mm through cutting. Thereafter, an unevenness shape, according to the invention as shown in Table 1, is formed on a flat portion between the resulting adjacent spiral groove portions as an assembly of columns each having a diameter of 1.5 mm and a height of 4.2 mm at bottom, with a density of 20 columns per 1 $cm^2$, through spot welding. Further, a WC-12%Co cermet is sprayed on the surface of the thus treated roll at a thickness of 0.08–0.09 mm. Then, the resulting roll is immersed in a galvanizing bath at a temperature of 480° C. As a result, a similar effect to that of Example 1 is obtained.

EXAMPLE 3

A V-shaped groove having a depth of 2.5 mm, a width of 7 mm and a pitch of 25 mm is spirally formed on a surface of a sink roll for galvanizing bath made from SUS 304 austenitic stainless steel having a diameter of 800 mm and a surface length of 1500 mm through cutting. Thereafter, a ceramic coating of chromium oxide having a thickness of 0.9–1.0 mm is formed on the surface of the roll. Then, an unevenness shape, according to the invention as shown in Table 1, is formed on a flat portion between the resulting adjacent spiral groove portions as an assembly of triangular pyramids each having a side of 2.5 mm and a height of 0.6 mm at bottom with a density of 16 pyramids per 1 $cm^2$, through laser beam processing. Then, the resulting roll is immersed in a galvanizing bath at a temperature of 480° C. As a result, a similar effect to that of Example 1 is obtained.

EXAMPLE 4

An outer peripheral surface of a sink roll for a galvanizing bath made from 13 Cr stainless steel having a diameter of 700 mm and a surface length of 1800 mm is divided into two equal parts in its axial direction, and thereafter one of the two equal parts (hereinafter referred to as A-portion) is provided with a spiral groove having a depth of 0.3 mm, a width of 1.5 mm and a pitch of 3 mm and the other part (hereinafter referred to as B-portion) is provided with a V-shaped spiral groove having a depth of 1.5 mm, a width of 6 mm and a pitch of 25 mm through cutting. Then, an unevenness shape, according to the invention as shown in Table 1, is formed on a flat portion between the resulting adjacent spiral groove portions of the B-portion as an assembly of square pyramids each having a side of 2.2 mm and a height of 0.7 mm at bottom with a density of 20 pyramids per 1 $cm^2$, through cutting. Further, a WC-12%Co cermet is sprayed on the surface of the thus treated roll at a thickness of 0.08–0.09 mm. The roll is actually used in a galvanizing bath at a temperature of 480° C. The evaluation of the thus treated roll surface immediately after the start of the operation is as follows. That is, the A-portion transfers its ununiform groove shape onto the steel sheet as a groove mark, and the time for disappearing such groove mark takes about 20 hours. On the contrary, when the steel sheet is passed about the B-portion, the ununiform pattern, such as a groove mark, is not observed immediately after the start of the operation. In the continuous operation of the B-portion, the similar effect to that of Example 1 is obtained.

As mentioned above, according to the invention, the surface of the sink roll for use in a hot-dipping bath is provided with a spiral groove for the discharge of dross and an unevenness formed on a flat portion between adjoining groove portions, and a coating layer of carbide, oxide, boride or a cermet thereof is formed on the surface of the roll, so that steel sheets having improved hot-dipped quality are obtained under stable hot-dipping action in a high productivity without causing uneven color tone and gloss called as a groove mark.

What is claimed is:

1. A roll for hot dipping bath comprising:

a roll having an outer peripheral surface;

at least one groove capable of discharging dross in said outer peripheral surface; and at least one portion of said outer peripheral surface having a roughness comprising undulations having a height within a range of 0.5–5 mm capable of applying a molten metal composition to a sheet of metal without transferring a groove mark to the sheet of metal.

2. The roll according to claim 1, wherein said undulations comprise convex regions including a flat top portion.

3. The roll according to claim 2, wherein said convex regions include a bottom portion and said flat top portion comprises a trapezoid smaller than said bottom portion.

4. The roll according to claim 1, wherein said undulations comprise convex regions having a shape selected from the group consisting of triangular pyramid, rectangular pyramid, prism, column, polygonal pyramid, cone, ellipsoid and spherical.

5. The roll according to claim 1, wherein said at least one groove comprises a spiral groove.

6. The roll according to claim 1, wherein said at least one groove has a shape selected from the group consisting of V-shape, U-shape and rectangle.

7. The roll according to claim 1, wherein said undulations comprise a plurality of convex regions including a flat top portion.

8. The roll according to claim 7, wherein said plurality of convex regions includes a bottom portion and said flat top portion comprises a trapezoid smaller than said bottom portion.

9. The roll according to claim 7, wherein said plurality of convex regions have a shape selected from the group consisting of triangular pyramid, rectangular pyramid, prism, column, polygonal pyramid, cone, ellipsoid and spherical.

10. The roll according to claim 1, wherein said undulations comprise a distribution of convex regions within a range of 10–250 regions/$cm^2$.

11. The roll according to claim 1, wherein said at least one rough outer peripheral surface includes an upper region covered with a layer selected from the group consisting of carbide, oxide, boride and cermet thereof.

12. The roll according to claim 1, wherein said hot-dipping is selected from the group consisting of galvanizing, aluminum hot-dipping, zinc-aluminum alloy hot-dipping and tin hot-dipping.

13. A roll for hot dipping bath comprising:

a roll having an outer peripheral surface;

at least one groove capable of discharging dross in said outer peripheral surface;

at least one portion of said outer peripheral surface having a roughness capable of applying a molten metal composition to a sheet of metal without transferring a groove mark to the sheet of metal;

said at least one groove comprises a plurality of grooves capable of discharging dross;

said at least one portion of said outer peripheral surface comprises a plurality of rough outer peripheral surfaces capable of applying a molten metal composition to a sheet of metal without transferring a groove mark to the sheet of metal; and said plurality of rough outer peripheral surfaces comprises a plurality of convex regions including a flat top portion.

14. The roll according to claim 13, wherein said plurality of convex regions includes a bottom portion and said flat top portion comprises a trapezoid smaller than said bottom portion.

15. The roll according to claim 13, wherein said plurality of convex regions have a height within a range of 0.5–5 mm.

16. The roll according to claim 13, wherein said plurality of convex regions have a shape selected from the group consisting of triangular pyramid, rectangular pyramid, prism, column, polygonal pyramid, cone, ellipsoid and spherical.

* * * * *

UNITED STATES PATENT AND TRADEMARK OFFICE

CERTIFICATE OF CORRECTION

PATENT NO. : 5,391,135

DATED : Feb. 21, 1995

INVENTOR(S) : N. KUROKI et al.

It is certified that error appears in the above-indentified patent and that said Letters Patent is hereby corrected as shown below:

On title page, item [56], line 27, change "58-32386" to ---58-37386---.

Column 1, lines 46 and 47, change ", so that" to --. Therefore,--

At column 2, line 41, before "composition" insert ---the---.

At column 2, line 54, delete "is".

At column 4, line 15, after "composition" insert ---,---.

At column 4, line 46, after "surface" insert --. In--

At column 4, line 63, change "width" to ---with---.

At column 8, line 24, after "Thereafter" insert ---,---.

At column 9, line 35, change "0.6" to ----0.5---.

UNITED STATES PATENT AND TRADEMARK OFFICE

CERTIFICATE OF CORRECTION

PATENT NO. : 5,391,135

DATED : February 21, 1995

INVENTOR(S) : N. KUROKI et al.

It is certified that error appears in the above-indentified patent and that said Letters Patent is hereby corrected as shown below:

At column 9, line 43, after "roll" insert ---,---.

At column 9, line 44, after "bath" insert ---,---.

At column 9, line 45, after "mm" (second occurrence) insert ---,---.

Signed and Sealed this

Thirty-first Day of December, 1996

Bruce Lehman

*Attest:*

BRUCE LEHMAN

*Attesting Officer*

*Commissioner of Patents and Trademarks*